US005146972A

United States Patent [19]

Tacchella

[11] Patent Number: 5,146,972

[45] Date of Patent: Sep. 15, 1992

[54] METHOD FOR DRAPING CURTAINS

[75] Inventor: William L. Tacchella, Sturgis, Mich.

[73] Assignee: Cooper Industries, Inc., Houston, Tex.

[21] Appl. No.: 825,217

[22] Filed: Jan. 24, 1992

[51] Int. Cl.[5] ..... A47H 1/00

[52] U.S. Cl. ..... 160/330; 160/349.2

[58] Field of Search ..... 160/330, 349.2, 348, 160/38, 19, 84.1

[56] References Cited

U.S. PATENT DOCUMENTS

| | | | |
|---|---|---|---|
| 2,244,129 | 6/1941 | Stratton | 160/349.2 X |
| 2,316,337 | 4/1943 | Kenney | 160/330 |
| 2,337,950 | 12/1943 | Werner et al. | 160/330 |
| 2,470,422 | 5/1949 | Wright | 160/348 |
| 4,284,258 | 8/1981 | Kleiman | 248/251 |
| 4,958,646 | 9/1990 | Hannershg | 160/348 |
| 5,018,567 | 5/1991 | Hannerstig | 160/348 |
| 5,074,348 | 12/1991 | Phillips | 160/330 X |

FOREIGN PATENT DOCUMENTS

| | | | |
|---|---|---|---|
| 2225232 | 5/1990 | United Kingdom | 160/330 |

*Primary Examiner*—Blair M. Johnson

*Attorney, Agent, or Firm*—Jackie L. Duke; Alan R. Thiele; Eddie Scott

[57] ABSTRACT

An improved method for draping curtains which allows one person to form a decorative window treatment without requiring any specialized skills or training. The method allows a curtain to be draped from a curtain rod of conventional configuration in a decorative manner about a window opening. The method uses hook and loop type fastening means to secure the curtain fabric to the curtain rod and thereby prevents the curtain from sagging at the top. Simple curtain rings are placed over the ends of the depending curtain fabric and then installed on the curtain rod near its ends to allow a portion of the curtain to form a decorative downwardly curved arc of fabric. The newly formed arc is then "dressed" or folded into pleats to complete the decorative window treatment. The improved method is also shown applied to a bay window treatment.

An alternate embodiment is shown with the draped end portion of the curtain fabric looped and fastened to the curtain rod to allow a decorative puff to be formed in the looped fabric adjacent the curtain rings.

17 Claims, 4 Drawing Sheets

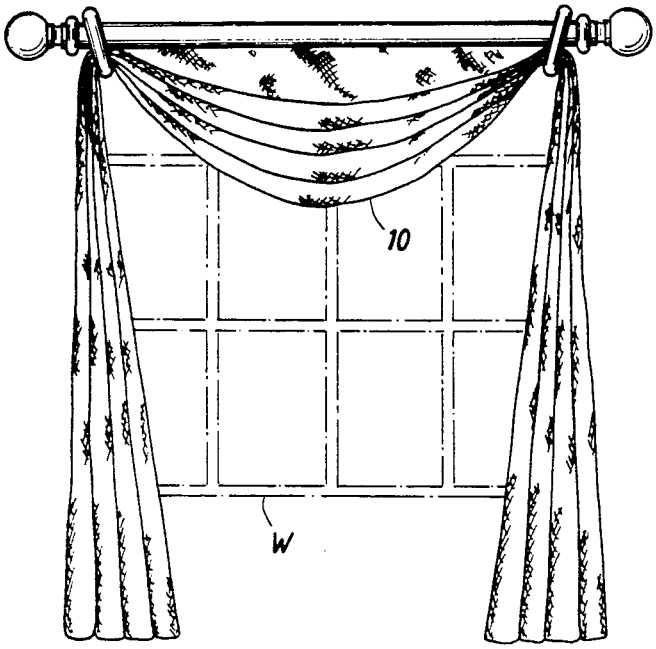
FIG. 1
FIG. 2
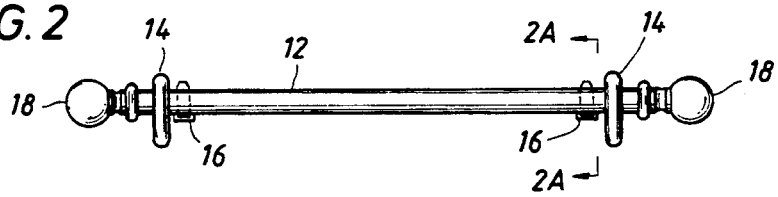
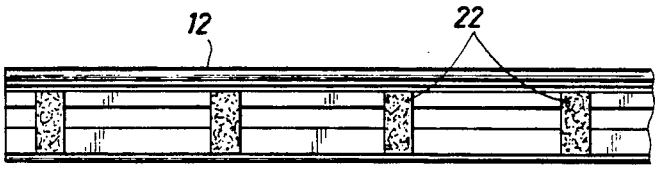
FIG. 3
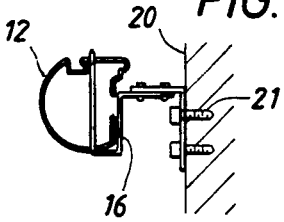
FIG. 2A
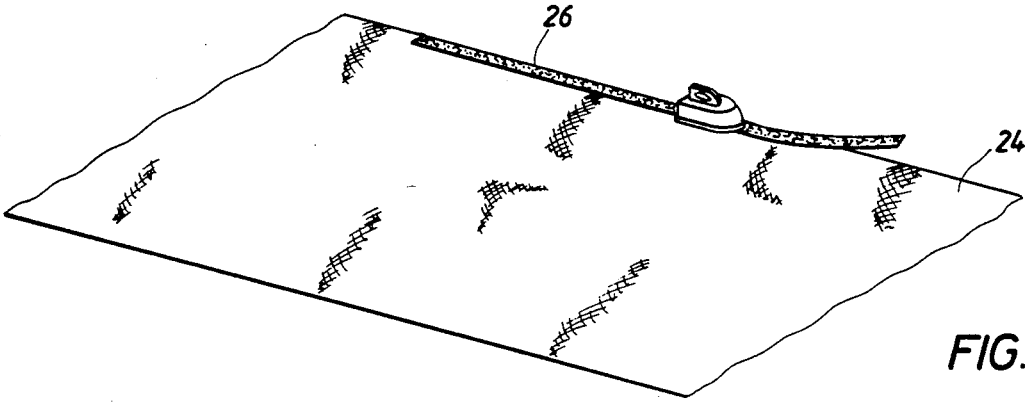
FIG. 4

FIG. 5
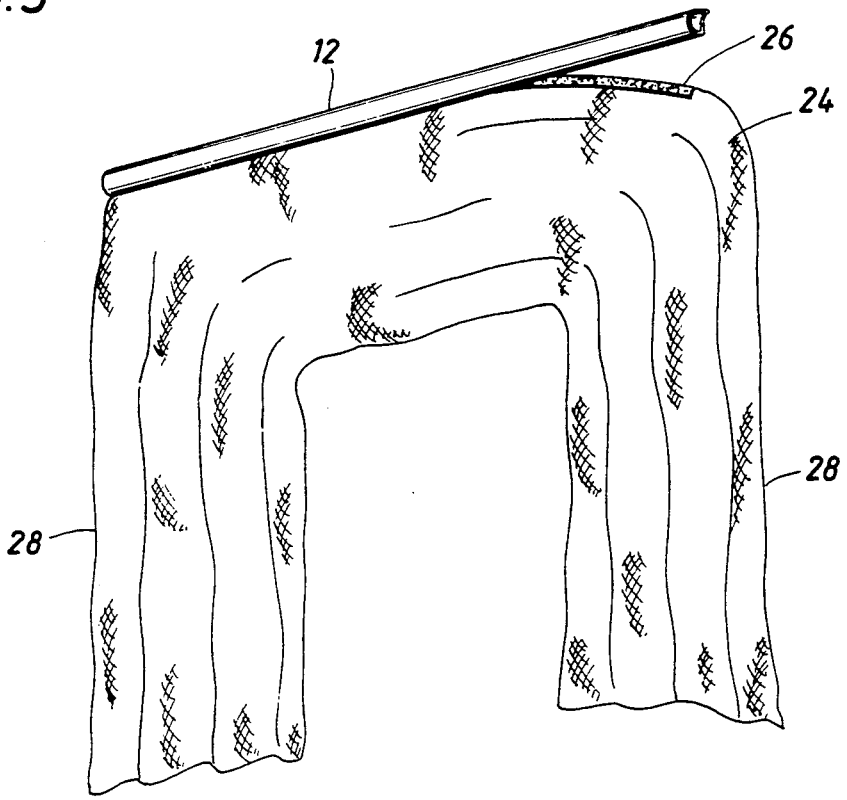
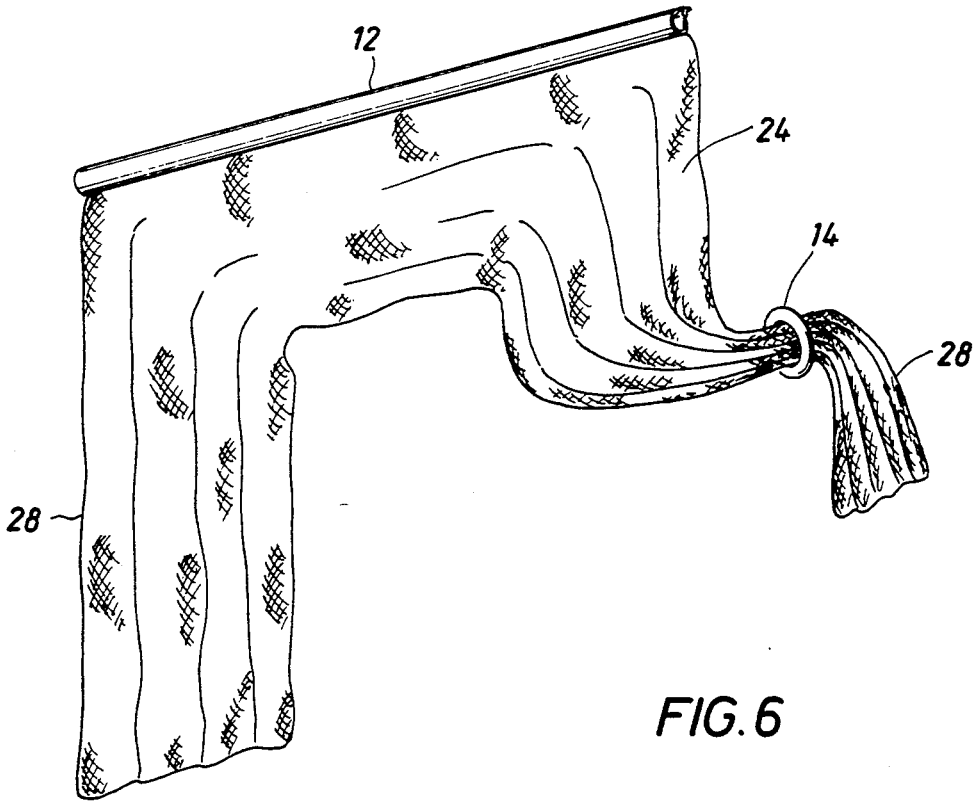
FIG. 6

METHOD FOR DRAPING CURTAINS

BACKGROUND

This invention relates to a method for draping curtains to provide a custom designed wall or window look quickly and inexpensively. Typically a window curtain is supported over a window on a horizontal rod attached to the wall with the curtain fabric hanging therefrom. A common decorative embellishment added to these window treatments is to drape the center portion of the curtain across the window in an arc. This window treatment often is further embellished by folding the draped portion of the curtain into evenly spaced folds for a neater appearance. This embellishment requires a considerable degree of skill to execute properly. In particular, it is often difficult to keep the curtain fabric taut adjacent the horizontal curtain rod or the folds of the curtain fabric evenly spaced. The present invention overcomes these problems by providing a method for draping and dressing the curtain fabric which can be easily performed by one person without requiring any special skills.

U.S. Pat. No. 4,284,258 to S. Kleiman discloses a festoon support device composed of a pair of specially shaped brackets secured to a wall for supporting a curtain in a festoon configuration.

U.S. Pat. No. 4,958,646 to C. Hannerstig discloses a method for draping curtains utilizing a special bracket from which the curtain fabric is draped. The special bracket further allows an ornamental fabric rosette to be formed on the special bracket without special skill or assistance.

U.S. Pat. No. 5,018,567 to C. Hannerstig, a continuation-in-part of U.S. Pat. No. 4,958,646, further defines a method for forming tie-back puffs utilizing the aforementioned special bracket.

SUMMARY

An improved method for draping curtains which allows one person to form a decorative window treatment without requiring any specialized skills or training. The method described hereinafter allows a curtain to be draped from a curtain rod of conventional configuration in a decorative manner about a window opening. The method uses hook and loop type fastening means to secure the curtain fabric to the curtain rod and thereby prevent the curtain from sagging at the top. Curtain rings are placed over the ends of the depending curtain fabric and then installed on the curtain rod near its ends to allow a portion of the curtain to form a decorative downwardly curved arc of fabric. The newly formed arc is then "dressed" or folded into pleats to complete the decorative window treatment. The improved method is also shown applied to a bay window treatment.

An alternate embodiment is shown with the draped end portion of the curtain fabric looped and fastened to the curtain rod to allow a decorative puff to be formed in the looped fabric adjacent the curtain rings.

An object of the present invention is to provide a method for forming a decoratively draped curtain window treatment which can be performed by one person without any specialized skills or training.

Another object of the present invention is to provide a method for decoratively draping window curtains which ensures the curtain fabric attachment to the rod is secure to prevent sagging of the upper portion of the curtain.

BRIEF DESCRIPTION OF THE DRAWINGS

These and other objects and advantages of the present invention are set forth below and further made clear by reference to the drawings, wherein:

FIG. 1 is an elevation view of the preferred embodiment of the current invention showing the resulting decorative window treatment.

FIG. 2 is an elevation view showing the curtain rod, holders and rings attached to a wall.

FIG. 2A is a sectional view taken along lines 2A—2A of FIG. 2 details of the curtain rod and attachment bracket.

FIG. 3 is an elevation view showing the rear of the curtain rod with the hook pads attached.

FIG. 4 is a perspective view showing loop tape being ironed on the front edge of the fabric.

FIG. 5 is a perspective view showing the front edge of the curtain fabric being attached to the rear of the curtain rod.

FIG. 6 is a perspective view showing the fabric tail being installed through the ring.

DESCRIPTION OF THE PREFERRED EMBODIMENT

Figure 7:
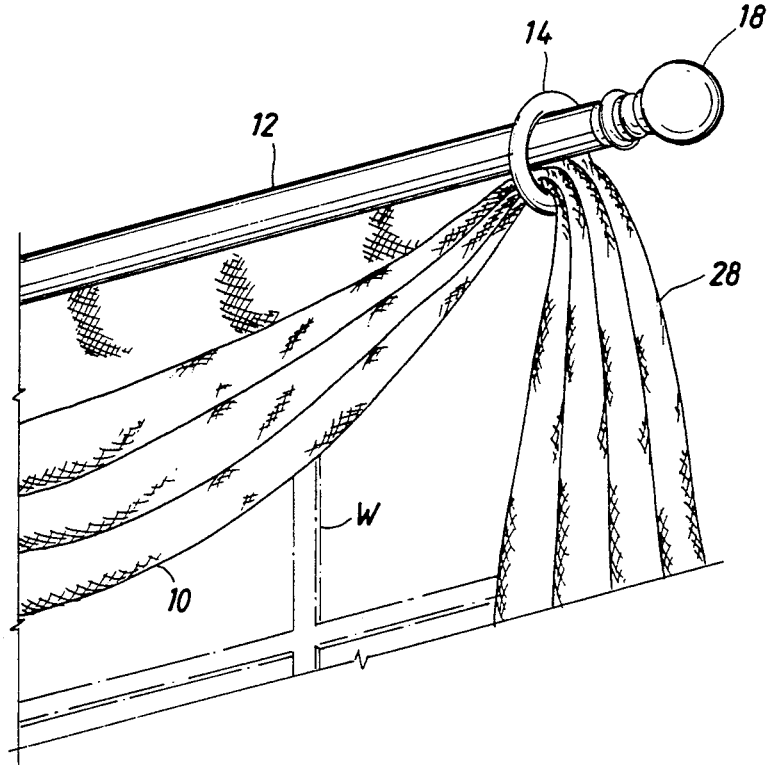
FIG. 7 is a perspective view of one end of the finished window ,treatment showing the draped arc of fabric after being pleated.

FIG. 1 shows a draped window W having a depending arc 10 of curtain fabric arranged in accordance with the method of the present invention. FIG. 2 is a perspective view showing the drapery hardware required for practicing the method of the present invention with the curtain fabric removed for clarity. This hardware includes curtain rod 12, curtain rings 14, curtain rod holders or brackets 16 and decorative end pieces or finials 18. Curtain rod 12 is of a conventional configuration, well known to those skilled in the art, with a generally C shaped cross section as seen in FIG. 2A. Alternatively, rod 12 could be a solid pole of wood or metal.

The window treatment shown in FIG. 1 is formed by first attaching brackets 16 (best seen in FIG. 2A) to a vertical wall 20 with fastening screws 21 in spaced relationship to support curtain rod 12 in a horizontal position and spaced from vertical wall 20. A suitable curtain fabric attachment means such as hook pads 22 are attached to the rear of curtain rod 12 in an evenly spaced array to support the curtain fabric 24. Curtain fabric 24 is measured and cut to cover the window opening W with sufficient extra fabric left on either side to form a "tail" as described hereinafter. The curtain fabric 24 is then hemmed and a curtain fabric attachment means such as loop tape 26, complementary to hook pads 22, is attached by ironing to the front face of curtain fabric 24 as seen in FIG. 4. Loop tape 26 is centered on the edge of curtain fabric 24 to allow forming the "tails" previously mentioned.

Curtain fabric 24 is attached to curtain rod 12 by pressing loop tape 26 into engagement with hook pads 22 on the rear of curtain rod 12 as seen in FIG. 5. The extra portion of curtain fabric 24 is suspended from curtain rod 12 to form a tail of material 28 at each end of the rod. As best seen in FIGS. 6 and 7, the fabric tail 28 is pulled through a curtain ring 14 which is then slid up the fabric tail 28 to a position near the end of the curtain rod 12. The depending arc 10 of curtain fabric 24 is then "dressed" to form a series of folds as shown in FIG. 1. It is to be noted the fabric tail 28 at either end of curtain rod 12 may be draped into various ornamental configurations which are aesthetically pleasing to the person using the claimed method without departing from the spirit of the invention.

Figure 8:
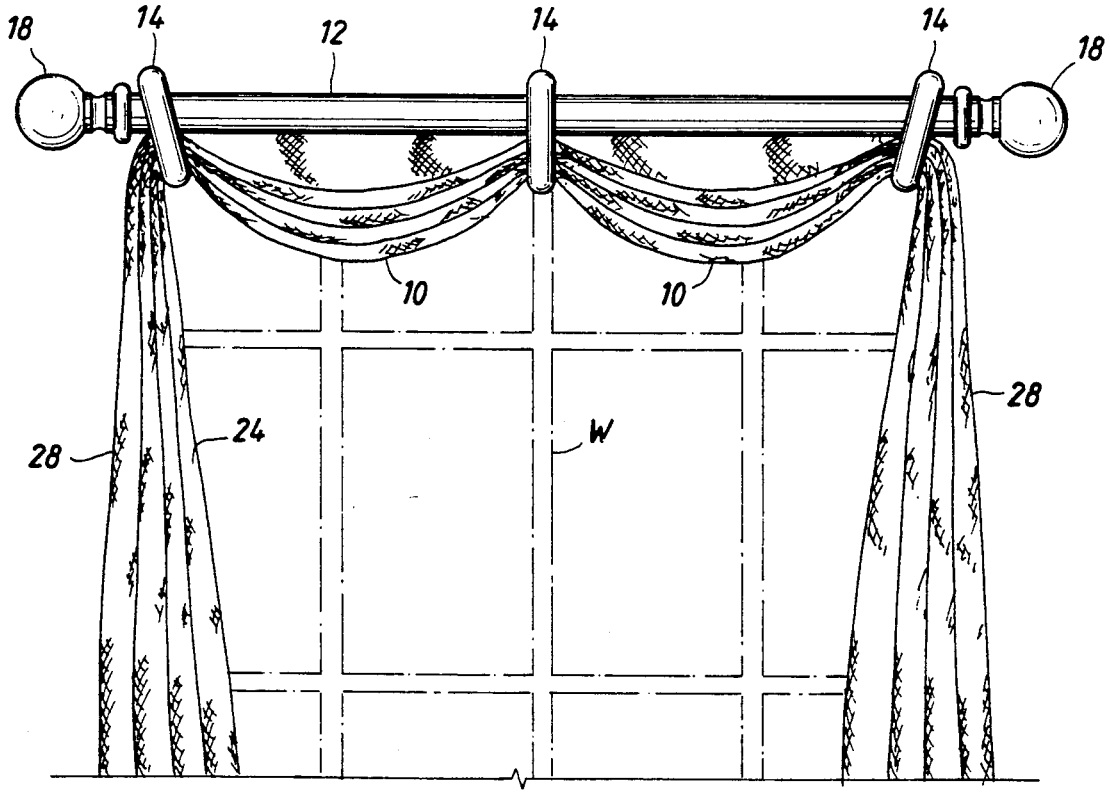
FIG. 8 is an elevation view of an alternate embodiment showing the addition of a third ring centered on the curtain rod to form two arcs of drapery material.

An alternate embodiment utilizing the claimed method is shown in FIG. 8. The curtain fabric 24 and curtain rod 12 are prepared and attached to one another as in the first embodiment. A third curtain ring 14 is used and slid over one of the tails of material 28 and onto the rod 12 where it is positioned at the center of the rod. The remaining two curtain rings 14 are installed to form two depending arcs 10 which are then dressed or pleated as in the first embodiment to form the decorative window treatment shown in FIG. 8.

Figure 9:
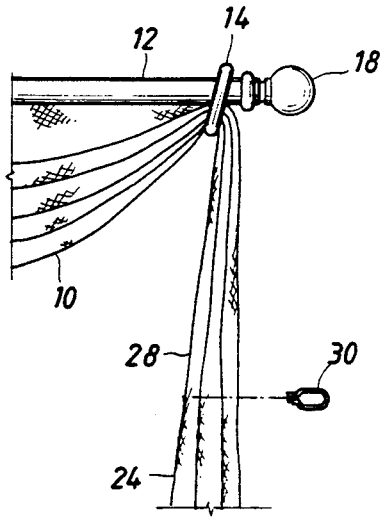
FIG. 9 is an elevation view of a second alternate embodiment showing a different treatment of the tail of the curtain.
Figure 10:
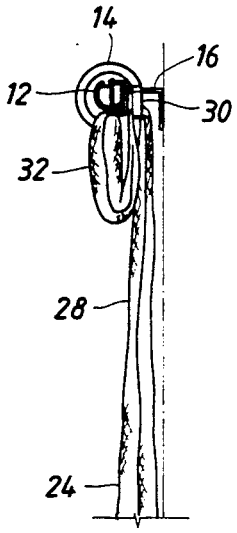
FIG. 10 is an end view of the second alternate embodiment of FIG. 9 showing details or the attachment of the curtain tail to the curtain rod bracket.
Figure 11:
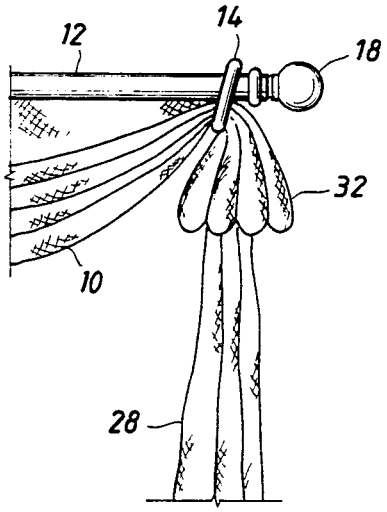
FIG. 11 is an elevation view of the finished second alternate window treatment showing the detail of the dressing of the draped portion of the curtain tail.
Figure 13:
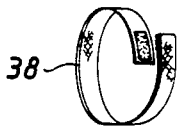
FIG. 13 is a perspective view of the fabric retaining means used in the bay window application.

A second alternate embodiment is shown in FIG. 9 where curtain fabric 24 and curtain rod 12 are prepared and attached to one another as in the preferred embodiment. Rings 14 are added as in the preferred embodiment to produce the configuration shown in FIG. 9. Curtain fabric retaining means as hook closure 30 are attached around the tail 28 a suitable distance from bracket 16 to allow tail 28 to be looped and attached to bracket 16 as shown in FIGS. 9 and 10. The depending looped fabric is then dressed to form puff 32 as seen in FIG. 11

Figure 12:
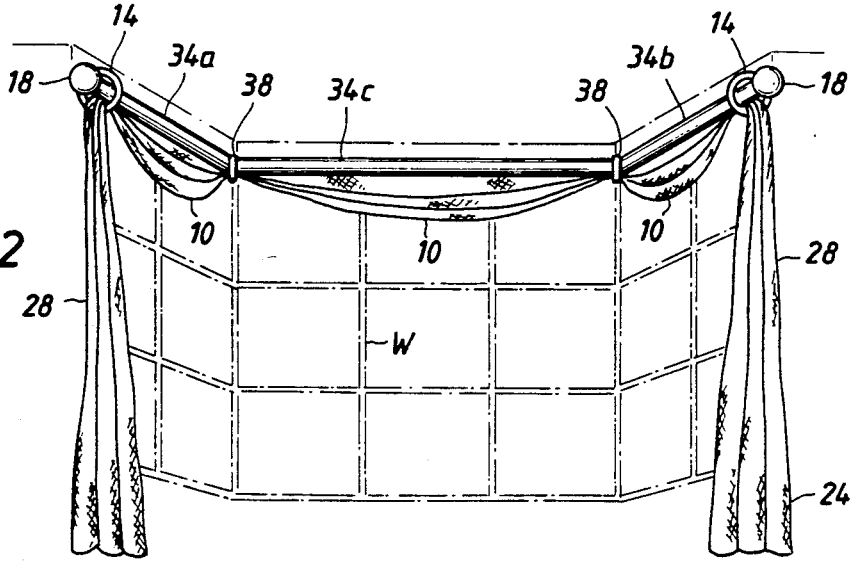
FIG. 12 is a perspective view of the current invention applied to a bay window treatment.

An application of the present invention to a bay window is shown in FIG. 12. Curtain rod 34 is made of wood with adjacent ends of left, right and center sections 34*a*, 34*b* and 34*c* mitered to ensure a proper fit. The sections 34*a*, 34*b* and 34*c* are mounted within bay window opening 36 by brackets similar to those used in the preferred embodiment. Hook pads are attached to the rear of the curtain rod sections 34*a*–34*c* and loop tape is attached to curtain fabric 24 by ironing. Curtain fabric 24 and curtain rod sections 34*a*–34*c* are then attached to one another as in the preferred embodiment. Rings 14 are added to the outer ends of curtain rod sections 34*a* and 34*b* as in the preferred embodiment. In order to produce the desired depending arcs on each adjoining section of curtain rod 34, curtain fabric retaining loops 38 are used at the corners of curtain rod 34 as brackets 16 (not shown) prevent rings 14 from being used at the corners of curtain rod 34. The depending arcs 10 are then "dressed" or pleated to produce the window treatment shown in FIG. 12. Curtain fabric retaining loops 38 are composed of a strip of fabric with a hook and loop patch attached to opposite ends thereby forming a continuous loop when pressed together.

What is claimed is:

1. A method for draping curtains comprising the steps of:

attaching a curtain fabric attachment means to the rear of a curtain rod, attaching a curtain fabric attachment means to the front, upper edge of a curtain, securing said curtain rod in a substantially horizontal position in spaced relationship to a vertical wall with at least two brackets, securing said curtain to said rear of said curtain rod utilizing said curtain fabric attachment means, and installing a pair of rings over the end portion of said curtain fabric and onto said curtain rod so that said curtain rod extends through said rings to form a draping arc between the end portions of said curtain rod.

2. A method for draping curtains according to claim 1 further comprising the steps of:

dressing said draping arc of curtain fabric to produce a series of folds in said draping arc.

3. A method for draping curtains according to claim 1 further comprising the steps of:

installing a third ring over the end portion of said curtain fabric and onto said curtain rod to form a pair of draping arcs between the end portions of said curtain rod.

4. A method for draping curtains according to claim 3 further comprising the steps of:

dressing said pair of draping arcs of curtain fabric to produce a series of pleats in said pair of draping arcs.

5. A method for draping curtains according to claim 1 wherein said fabric attachment means for said rod is an adhesive backed hook pad.

6. A method for draping curtains according to claim 1 wherein said fabric attachment means for said curtain is a heat activated adhesive backed loop tape.

7. A method for draping curtains comprising the steps of:

securing a pair of curtain rod brackets to opposing sides of an opening in a substantially vertical wall above said opening wherein said curtain rod brackets project outwardly from said wall to secure a horizontally disposed curtain rod in spaced relationship to said wall, attaching a curtain fabric attachment means to the rear of said curtain rod, cutting and hemming a portion of curtain fabric to form a curtain of a size to allow said curtain to cover said wall opening with a depending end portion suspended on either side of said wall opening, attaching a curtain fabric attachment means to the front, upper edge of said curtain, securing said curtain rod in said curtain rod brackets, securing said curtain to said rear of said curtain rod utilizing said curtain fabric attachment means, and pulling each of said depending end portions of said curtain through a ring and installing said ring onto said curtain rod so that said curtain rod extends through said ring to form a draping arc between the end portions of curtain rod.

8. A method for draping curtains according to claim 7 further comprising the steps of:

dressing said draping arc of curtain fabric to produce a series of folds in said draping arc.

9. A method for draping curtains according to claim 8 further comprising the steps of:

forming a loop of the upper end of said depending end portions of said curtain fabric, securing said loop to said curtain rod bracket with curtain fabric retaining means, and arranging said loop of curtain fabric to form a fabric puff.

10. A method for draping curtains according to claim 9 wherein said curtain fabric retaining means is a hook closure.

11. A method for draping curtains according to claim 7 wherein said fabric attachment means for said rod is an adhesive backed hook pad.

12. A method for draping curtains according to claim 7 wherein said fabric attachment means for said curtain is a heat activated adhesive backed loop tape.

13. A method for draping curtains in a bay window comprising the steps of:

securing a plurality of curtain rod brackets to the sides of a bay window opening in a substantially vertical wall wherein said curtain rod brackets project outwardly to secure a plurality of horizontally disposed curtain rod sections in spaced relationship within said bay window opening, attaching a curtain fabric attachment means to the rear of said curtain rod sections, cutting and hemming a portion of curtain fabric to form a curtain of a size to allow said curtain to cover said bay window with a depending end portion suspended on either side of said bay window opening, attaching a curtain fabric attachment means to the front, upper edge of said curtain, securing said curtain rod sections in said curtain rod brackets, securing said curtain to said rear of said curtain rod sections utilizing said curtain fabric attachment means, pulling each of said depending end portions of said curtain through a ring and installing said ring onto the outer end of said curtain rods so that said curtain rod extends through said ring and placing curtain fabric retaining means around said curtain fabric and curtain rod sections in such a way as to form a draping arc between the ends of said curtain rod sections.

14. A method for draping curtains according to claim 13 further comprising the steps of:

dressing said draping arcs of curtain fabric to produce a series of folds in said draping arcs.

15. A method for draping curtains according to claim 13 wherein said fabric attachment means for said rod sections is an adhesive backed hook pad.

16. A method for draping curtains according to claim 13 wherein said fabric attachment means for said curtain is a heat activated adhesive backed loop tape.

17. A method for draping curtains according to claim 16 wherein said curtain fabric retaining means is a strip of curtain fabric with hook and loop closure means.

* * * * *